US006496662B1

(12) United States Patent
Buchanan et al.

(10) Patent No.: US 6,496,662 B1
(45) Date of Patent: Dec. 17, 2002

(54) OPTICAL TONER LOW SENSOR

(75) Inventors: John Andrew Buchanan, Lexington, KY (US); Benjamin Keith Newman, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/174,769

(22) Filed: Jun. 19, 2002

(51) Int. Cl.[7] ..... G03G 15/08
(52) U.S. Cl. ..... 399/27
(58) Field of Search ..... 399/27, 28, 30, 399/49, 61, 64

(56) References Cited

U.S. PATENT DOCUMENTS

| | | | |
|---|---|---|---|
| 4,155,652 | A | 5/1979 | Buchan et al. |
| 4,646,679 | A | 3/1987 | Ohno et al. |
| 4,963,929 | A | 10/1990 | Ueda et al. |
| 5,036,358 | A | 7/1991 | Yoshida |
| 5,587,770 | A | 12/1996 | Jo et al. |
| 5,621,221 | A | 4/1997 | Shinohara et al. |
| 5,899,597 | A | 5/1999 | Shinohara et al. |
| 6,173,130 | B1 | 1/2002 | Oguma |

FOREIGN PATENT DOCUMENTS

JP 09-80892 A * 3/1997 ..... G03G/15/08

* cited by examiner

*Primary Examiner*—Arthur T. Grimley
*Assistant Examiner*—Ryan Gleitz
(74) *Attorney, Agent, or Firm*—John A. Brady

(57) ABSTRACT

Toner exhaustion is sensed in cartridge (1) having a toner chamber (3), a rotation paddle (7) extending across the long dimension. Chamber (3) has a transparent window (21) at its bottom and a reflective surface (23) in chamber (3), also at the bottom. An optical emitter and receiver (31) periodically senses for returned light, which indicates toner low. Paddle (7) carries a wiper to clean window and reflective surface. This provides improved accuracy by a cost-effective system.

8 Claims, 4 Drawing Sheets

OPTICAL TONER LOW SENSOR

TECHNICAL FIELD

This invention relates to electrophotographic process cartridges having toner and is directed to sensing the exhaustion of toner so that such information can be signaled to the imaging machine operator or otherwise acted upon.

BACKGROUND OF THE INVENTION

A number of alternatives are known for sensing the amount of toner is an imaging process cartridge. In cartridges in which a toner paddle stirs the toner during operation, the paddle has been driven through a torque sensitive drive train and the torque sensed has been used to determine the amount of toner remaining. The toner-low sensing of this invention is believed to be more accurate and more cost-effective than such systems in practices.

Similarly, the amount of toner has been determined by weighing the cartridge, with the reduction in weight defining the use of toner. This requires accurate knowledge of the empty weight of the cartridge and accurate weighting mechanism in the printer in varying environment and over the life of the printer. The toner low sensing of this invention also is believed to be more accurate and more cost-effective than such systems.

A number of optical systems are known, using transparent windows in the toner cartridge and optical paths through the toner. In some of these systems a relative small well is formed in the cartridge for toner to occupy, and an optical source is positioned on one side of the well and an optical receiver is positioned to receive light which passes through the well. If no or very low level of light reaches the sensor, this is interpreted as toner still being in the cartridge at the level of the well. It is known to have the well at or near the bottom of the cartridge so as to sense toner exhaustion or near exhaustion. Some of such optical paths might be somewhat complex or lengthy. The toner low sensing of this invention employs optical sensing, but in a short path and without a well.

DISCLOSURE OF THE INVENTION

In accordance with this invention, the cartridge may have a single window wide enough to permit light to enter the cartridge from a source in the imaging device, be reflected, and then return through the window to a sensor in the imaging device. The window is positioned near the bottom of the toner chamber. The cartridge has a long dimension and has an internal stirring paddle mounted along the long dimension. The cartridge has at least on side generally perpendicular to the long dimension of the cartridge in which the window (or windows) is located. A reflector is mounted in the toner chamber, also near the bottom of the toner chamber, parallel to the window, and not more than 40 millimeters from the window. The paddle carries a compliant blade across the window and the reflector to clean them for sensing.

A high level of light from the source reaching the sensor senses toner low. Because of the positioning near the bottom of the toner container, the most critical information indicative of toner exhaustion is obtained in an accurate and cost-effective system.

BRIEF DESCRIPTION OF THE DRAWINGS

The details of this invention will be described in connection with the accompanying drawings, in which.

DESCRIPTION OF THE PREFERRED EMBODIMENTS

Figure 1:
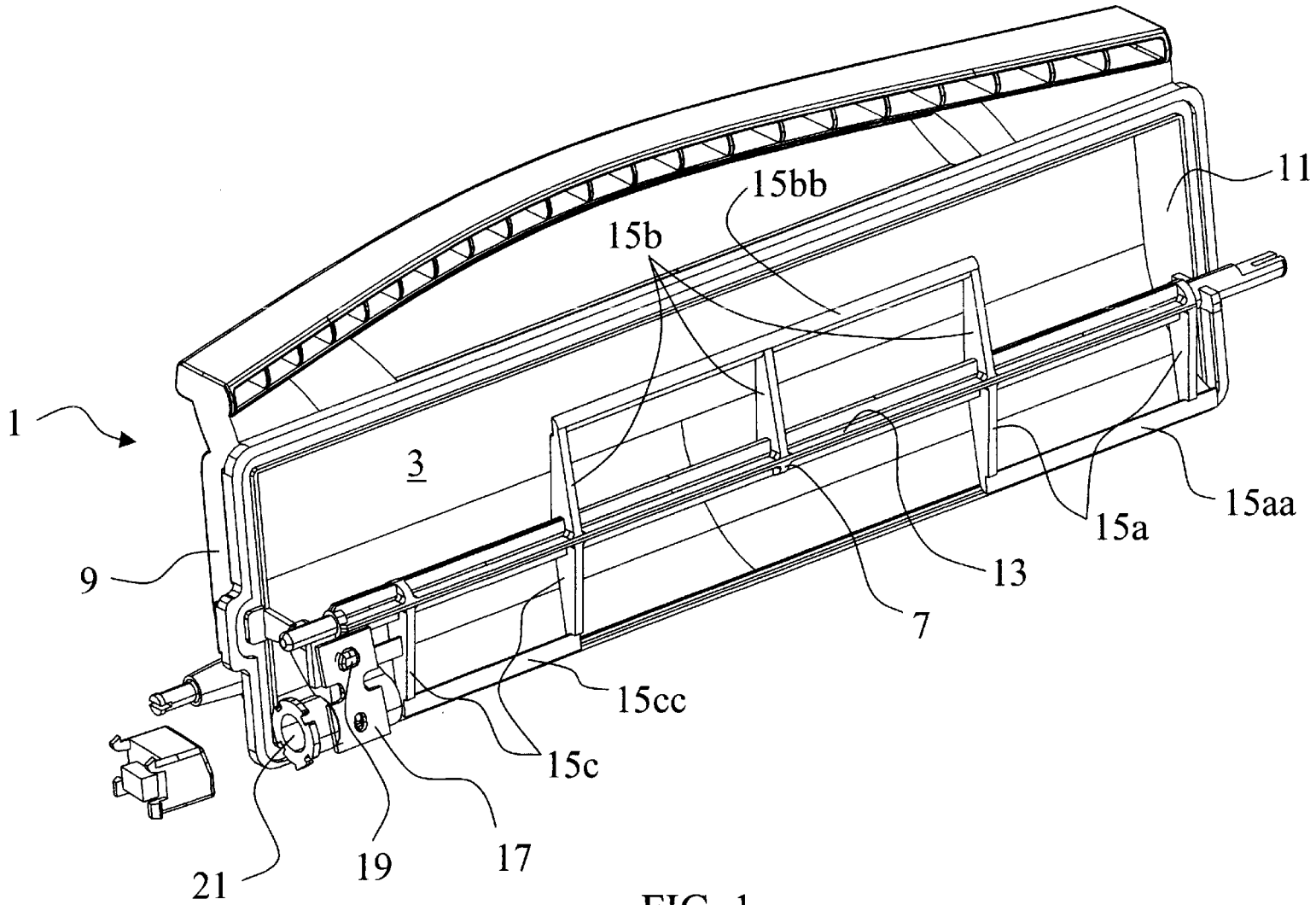
FIG. 1 shows a sectioned perspective view of a toner cartridge having a chamber for toner.

FIG. 1 shows a section view of a toner cartridge 1 having a toner chamber 3. Chamber 3 normally contains toner 5 (see FIG. 2, not shown in the other figures for clarity).

Toner chamber 3 has a long dimension in which a toner paddle 7 is mounted. Paddle 7 extends across the long dimension and generally perpendicular to the left side 9 and right side 11 of cartridge 1, as seen in FIG. 1.

Paddle 7 has a central, driven shaft 13 extending across the long dimension of chamber 3 which is rotated in normal use by a driving member from an imaging device (not shown). Paddle 7 has stirring extensions 15*a*, 15*b*, and 15*c*, which extend to near the outer walls of chamber 3 and which have cross members 15*aa*, 15*bb*, and 15*cc* extending parallel to shaft 13. Extension 15*b* is on opposite extensions 15*a* and 15*c* and cross member 15*bb* is wider than cross members 15*aa* or 15*cc* so as to distribute the stirring action of paddle 7. Paddle 7 with shaft 13 and extensions 15*a*–15*c* and cross members 15*aa*–15*cc*, rotated by being driven from an imaging device, are essentially well known in the art and therefore will not be described in additional detail.

At the left end of shaft 13, is a single flexible wiper blade 17, made of a solid urethane polymer. Wiper blade 17 is mounted to shaft 13 by studs (top stud numbered) 19 fixed on an extension from shaft 13, and may be fixed to shaft 13 by alternatives such as being wrapped around shaft 13 and held by adhesive or by a rivet, for example.

On the left side and at the bottom of chamber 3 is a transparent plate or window 21. Window 21 may be any material which is transparent to infrared light and is sturdy enough to hold toner 5 inside of the cartridge. Specifically, window 21 is made of polycarbonate.

Figure 3:
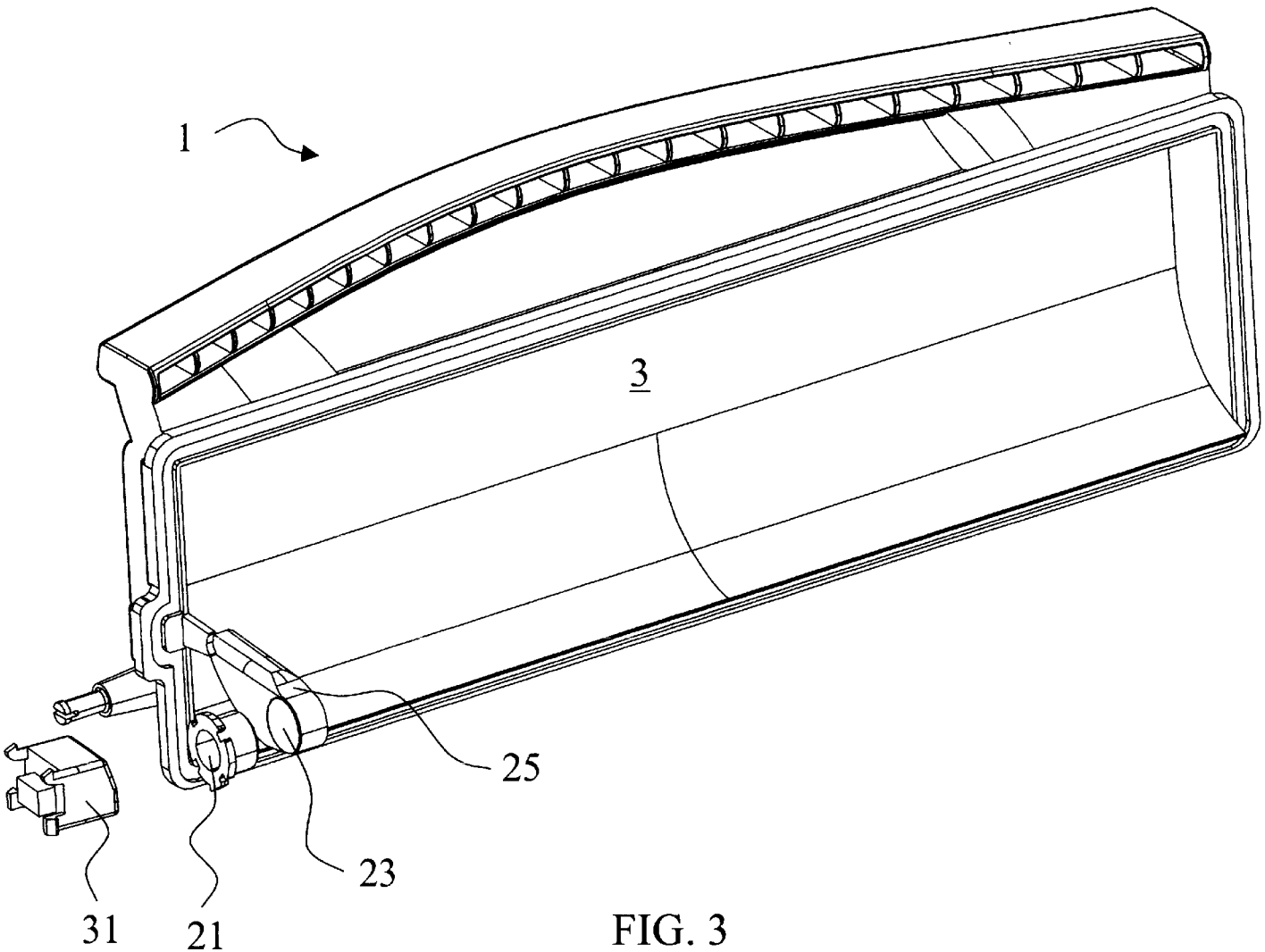
FIG. 3 illustrates the optical system of this invention viewed from the outside of the cartridge.

As best seen in FIG. 3, opposite window 21 and also at the bottom of chamber 3 is a reflective surface 23. Reflective surface 23 is spaced about 9 millimeters away from window 21, and should not be farther than 40 millimeters for suitable operation at low cost. With reference again to FIG. 1, it will be apparent that opposite sides of wiper blade 17 extend outward so as to brush against window 21 and reflective surface 23 during each revolution of paddle 7, thereby cleaning the two surfaces to allow light to pass window 21 and be reflected by surface 23 back through window 21.

Reflective surface 23 is an aluminized plastic sheet which is physically supported in chamber 3 by an extension 25 from the back of chamber, although other supports, such as the bottom of chamber 3, are certainly alternatives. As paddle 7 rotates during use, it distributes toner 5 so that toner remaining after use tends to settle evenly across the bottom of chamber 3, including the area of the bottom of chamber 3 between window 21 and reflective surface 23.

Figure 2:
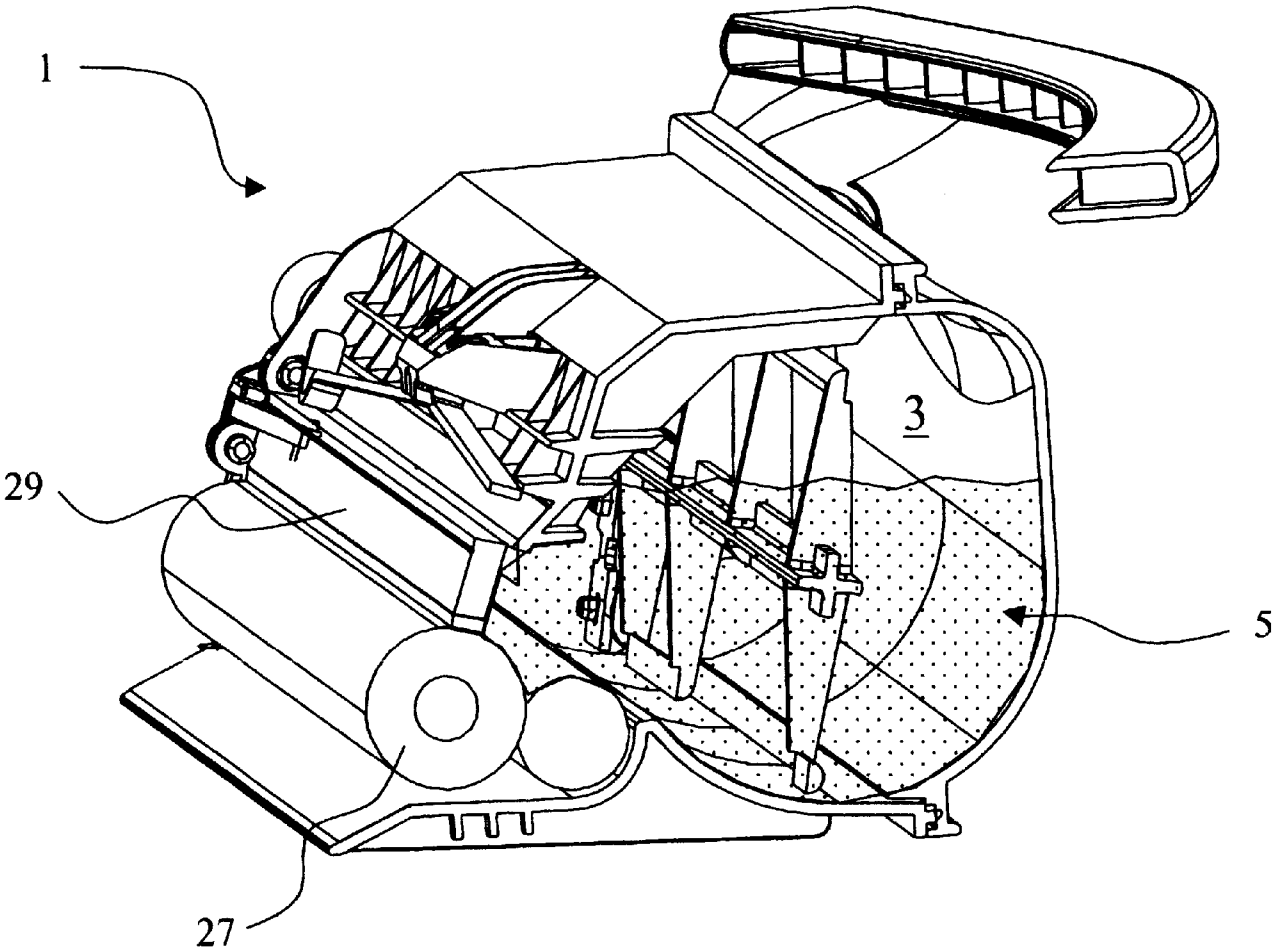
FIG. 2 is sectioned, perspective view from a side showing the rollers and doctor blade making up one side of the toner chamber.

As shown in cross section in FIG. 2, toner 5 is contained in chamber 3 on one side by a developer roller 27 with a doctor blade 29 pressing against the top of developer roller 27. Toner 5 leaves chamber one in small amounts carried between roller 27 and blade 29. Paddle 7 distributes the remaining toner 5 so that it is available to the developer roller 27. Such a configuration and operation are entirely conventional.

Developer roller 27 must be at least the width of the paper or other media being imaged. Normally this is somewhat more than the 8 and ½ inches width of paper widely used in the United States. Accordingly the long dimension of cartridge 1 as discussed in the foregoing is at least more than 8 and ½ inches, while the sides 9 and 11, are smaller as larger sides would make cartridge 1 unduly heavy and bulky.

Figure 4:
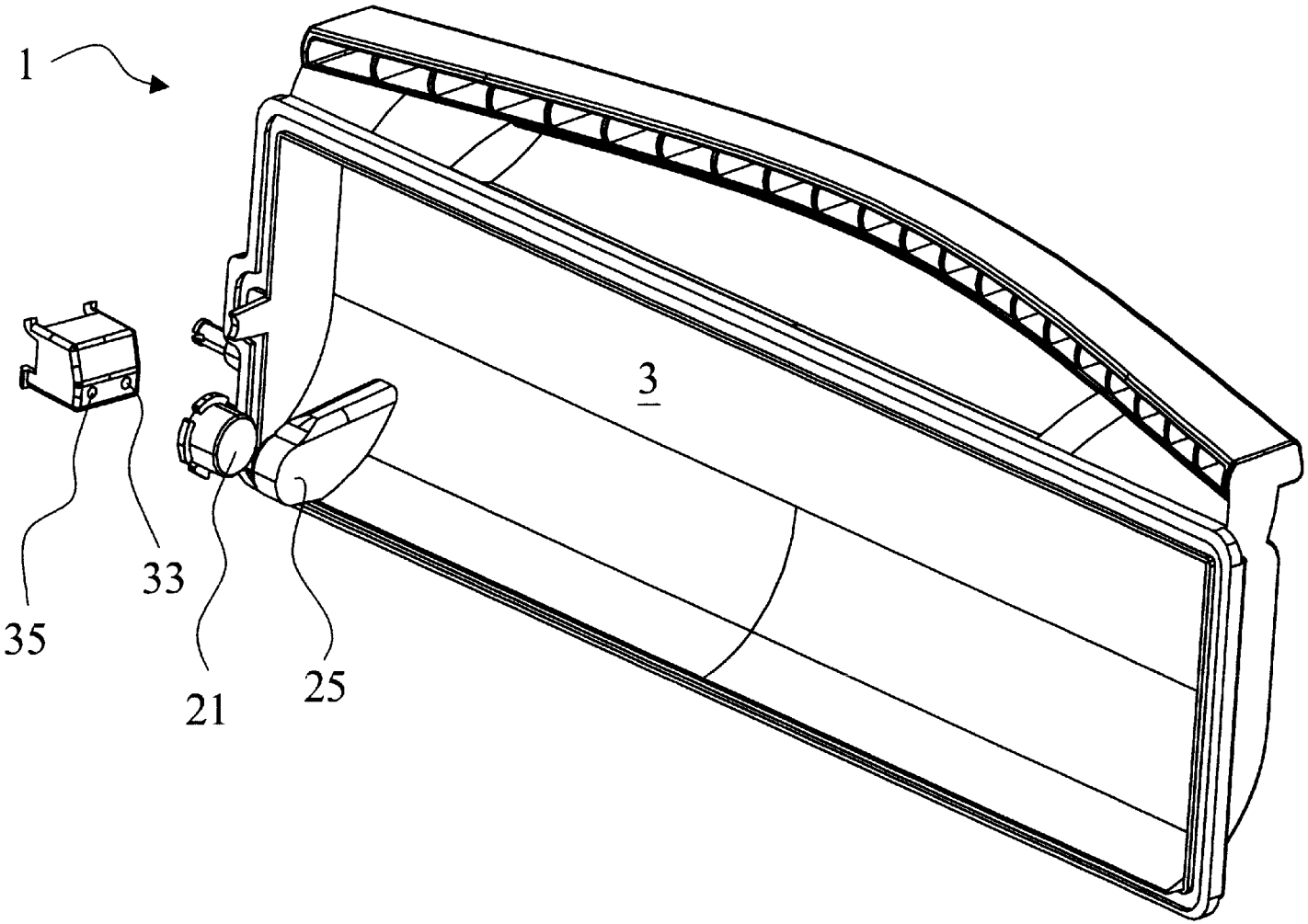
FIG. 4 illustrates the optical system of this invention viewed from the inside of the cartridge.

Spaced outside of cartridge 1 as part of the imaging device (not shown) using cartridge 1 is the optical element 31. Optical element 31 is positioned immediately outside window 21. As best seen in FIG. 4, optical element 31 has an infrared emitter 33 and an infrared receiver 35 mounted together for structural convenience. A separate emitter and separate receiver are clearly alternatives.

In use, at periodic intervals, the electronic controls of imaging device (not shown) having optical element 31, cause infrared to be emitted from emitter 33 and causes any sensing of that infrared on receiver 35 to be observed. The sensing of strong, reflected infrared from emitter 33 by receiver 35 is interpreted as toner low. In response to this the imaging device (not shown) may signal this to an operator, shut down automatically, or otherwise take appropriate action.

Such measurement of toner exhaustion is quite accurate and involves only modest cost.

What is claimed is:

1. A toner cartridge having a long dimension and two opposite sides forming a chamber for toner comprising a toner paddle mounted across said long dimension for rotation to stir toner, an optically transparent area on one of said two sides located at the bottom of said chamber for toner, a reflective surface located in said chamber at the bottom of said chamber spaced away from said transparent area a distance of not more than 40 millimeters.

2. The toner cartridge of claim 1 in which said reflective surface is spaced away from said transparent area a distance of about 9 millimeters.

3. The toner cartridge of claim 1 in which said paddle carries a wiping element, which wipes said transparent area and said reflective surface as said paddle rotates.

4. The toner cartridge of claim 2 in which said paddle carries a wiping element, which wipes said transparent area and said reflective surface as said paddle rotates.

5. The toner cartridge of claim 1 in which said toner chamber contains toner for imaging.

6. The toner cartridge of claim 2 in which said toner chamber contains toner for imaging.

7. The toner cartridge of claim 3 in which said toner chamber contains toner for imaging.

8. The toner cartridge of claim 4 in which said toner chamber contains toner for imaging.

* * * * *